US007948457B2

(12) United States Patent
Kothari et al.

(10) Patent No.: US 7,948,457 B2
(45) Date of Patent: May 24, 2011

(54) SYSTEMS AND METHODS OF ACTUATING MEMS DISPLAY ELEMENTS

(75) Inventors: Manish Kothari, Cupertino, CA (US); William J. Cummings, Millbrae, CA (US)

(73) Assignee: QUALCOMM MEMS Technologies, Inc., San Diego, CA (US)

( * ) Notice: Subject to any disclaimer, the term of this patent is extended or adjusted under 35 U.S.C. 154(b) by 541 days.

(21) Appl. No.: 11/404,449

(22) Filed: Apr. 14, 2006

(65) Prior Publication Data

US 2006/0250350 A1 Nov. 9, 2006

(51) Int. Cl.
*G09G 3/34* (2006.01)

(52) U.S. Cl. ..... 345/85; 345/108

(58) Field of Classification Search ..... 345/204, 345/84–86, 55, 105, 106, 108, 109
See application file for complete search history.

(56) References Cited

U.S. PATENT DOCUMENTS

| | | | | |
|---|---|---|---|---|
| 3,982,239 | A | 9/1976 | Sherr | |
| 4,403,248 | A | 9/1983 | te Velde | |
| 4,441,791 | A | 4/1984 | Hornbeck | |
| 4,459,182 | A | 7/1984 | te Velde | |
| 4,482,213 | A | 11/1984 | Piliavin et al. | |
| 4,500,171 | A | 2/1985 | Penz et al. | |
| 4,519,676 | A | 5/1985 | te Velde | |
| 4,566,935 | A | 1/1986 | Hornbeck | |
| 4,571,603 | A | 2/1986 | Hornbeck et al. | |
| 4,596,992 | A | 6/1986 | Hornbeck | |
| 4,615,595 | A | 10/1986 | Hornbeck | |
| 4,662,746 | A | 5/1987 | Hornbeck | |
| 4,681,403 | A | 7/1987 | te Velde et al. | |
| 4,709,995 | A | 12/1987 | Kuribayashi et al. | 345/89 |
| 4,710,732 | A | 12/1987 | Hornbeck | |
| 4,856,863 | A | 8/1989 | Sampsell et al. | |
| 4,859,060 | A | 8/1989 | Katagiri et al. | |
| 4,954,789 | A | 9/1990 | Sampsell | |
| 4,956,619 | A | 9/1990 | Hornbeck | |
| 4,982,184 | A | 1/1991 | Kirkwood | |
| 5,018,256 | A | 5/1991 | Hornbeck | |
| 5,028,939 | A | 7/1991 | Hornbeck et al. | |
| 5,037,173 | A | 8/1991 | Sampsell et al. | |
| 5,055,833 | A | 10/1991 | Hehlen et al. | |
| 5,061,049 | A | 10/1991 | Hornbeck | |
| 5,068,649 | A | 11/1991 | Garrett | 345/89 |
| 5,078,479 | A | 1/1992 | Vuilleumier | |
| 5,079,544 | A | 1/1992 | DeMond et al. | |

(Continued)

FOREIGN PATENT DOCUMENTS

| | | | |
|---|---|---|---|
| EP | 0295802 | A | 12/1988 |

(Continued)

OTHER PUBLICATIONS

International Search Report dated Jan. 29, 2007.

(Continued)

*Primary Examiner* — Kevin M Nguyen
(74) *Attorney, Agent, or Firm* — Knobbe Martens Olson & Bear, LLP

(57) ABSTRACT

Methods of writing display data to MEMS display elements are configured to minimize charge buildup and differential aging. Prior to writing rows of image data, a pre-write operation is performed. The pre-write operation with either actuate or release substantially all pixels in a row prior to writing the image data. In some embodiments, the selection between actuating or releasing is performed in a random or pseudo-random manner.

20 Claims, 10 Drawing Sheets

U.S. PATENT DOCUMENTS 5,083,857 A 1/1992 Hornbeck
5,096,279 A 3/1992 Hornbeck et al.
5,099,353 A 3/1992 Hornbeck
5,124,834 A 6/1992 Cusano et al.
5,142,405 A 8/1992 Hornbeck
5,142,414 A 8/1992 Koehler et al.
5,162,787 A 11/1992 Thompson et al.
5,168,406 A 12/1992 Nelson
5,170,156 A 12/1992 DeMond et al.
5,172,262 A 12/1992 Hornbeck
5,179,274 A 1/1993 Sampsell
5,192,395 A 3/1993 Boysel et al.
5,192,946 A 3/1993 Thompson et al.
5,206,629 A 4/1993 DeMond et al.
5,212,582 A 5/1993 Nelson
5,214,419 A 5/1993 DeMond et al.
5,214,420 A 5/1993 Thompson et al.
5,216,537 A 6/1993 Hornbeck
5,226,099 A 7/1993 Mignardi et al.
5,227,900 A 7/1993 Inaba et al.
5,231,532 A 7/1993 Magel et al.
5,233,385 A 8/1993 Sampsell
5,233,456 A 8/1993 Nelson
5,233,459 A 8/1993 Bozler et al.
5,254,980 A 10/1993 Hendrix et al.
5,272,473 A 12/1993 Thompson et al.
5,278,652 A 1/1994 Urbanus et al.
5,280,277 A 1/1994 Hornbeck
5,285,196 A 2/1994 Gale
5,287,096 A 2/1994 Thompson et al.
5,287,215 A 2/1994 Warde et al.
5,296,950 A 3/1994 Lin et al.
5,305,640 A 4/1994 Boysel et al.
5,312,513 A 5/1994 Florence et al.
5,323,002 A 6/1994 Sampsell et al.
5,325,116 A 6/1994 Sampsell
5,327,286 A 7/1994 Sampsell et al.
5,331,454 A 7/1994 Hornbeck
5,339,116 A 8/1994 Urbanus et al.
5,365,283 A 11/1994 Doherty et al.
5,411,769 A 5/1995 Hornbeck
5,444,566 A 8/1995 Gale et al.
5,446,479 A 8/1995 Thompson et al.
5,448,314 A 9/1995 Heimbuch et al.
5,452,024 A 9/1995 Sampsell
5,454,906 A 10/1995 Baker et al.
5,457,493 A 10/1995 Leddy et al.
5,457,566 A 10/1995 Sampsell et al.
5,459,602 A 10/1995 Sampsell
5,461,411 A 10/1995 Florence et al.
5,488,505 A 1/1996 Engle
5,489,952 A 2/1996 Gove et al.
5,497,172 A 3/1996 Doherty et al.
5,497,197 A 3/1996 Gove et al.
5,499,062 A 3/1996 Urbanus
5,506,597 A 4/1996 Thompson et al.
5,515,076 A 5/1996 Thompson et al.
5,517,347 A 5/1996 Sampsell
5,523,803 A 6/1996 Urbanus et al.
5,526,051 A 6/1996 Gove et al.
5,526,172 A 6/1996 Kanack
5,526,688 A 6/1996 Boysel et al.
5,535,047 A 7/1996 Hornbeck
5,548,301 A 8/1996 Kornher et al.
5,551,293 A 9/1996 Boysel et al.
5,552,924 A 9/1996 Tregilgas
5,552,925 A 9/1996 Worley
5,563,398 A 10/1996 Sampsell
5,567,334 A 10/1996 Baker et al.
5,570,135 A 10/1996 Gove et al.
5,578,976 A 11/1996 Yao
5,581,272 A 12/1996 Conner et al.
5,583,688 A 12/1996 Hornbeck
5,589,852 A 12/1996 Thompson et al.
5,597,736 A 1/1997 Sampsell
5,598,565 A 1/1997 Reinhardt
5,600,383 A 2/1997 Hornbeck
5,602,671 A 2/1997 Hornbeck
5,606,441 A 2/1997 Florence et al.
5,608,468 A 3/1997 Gove et al.
5,610,438 A 3/1997 Wallace et al.
5,610,624 A 3/1997 Bhuva
5,610,625 A 3/1997 Sampsell
5,612,713 A 3/1997 Bhuva et al.
5,619,061 A 4/1997 Goldsmith et al.
5,619,365 A 4/1997 Rhoades et al.
5,619,366 A 4/1997 Rhoads et al.
5,629,790 A 5/1997 Neukermans et al.
5,633,652 A 5/1997 Kanbe et al.
5,636,052 A 6/1997 Arney et al.
5,638,084 A 6/1997 Kalt
5,638,946 A 6/1997 Zavracky et al.
5,646,768 A 7/1997 Kaeiyama
5,650,881 A 7/1997 Hornbeck
5,654,741 A 8/1997 Sampsell et al.
5,657,099 A 8/1997 Doherty et al.
5,659,374 A 8/1997 Gale, Jr. et al.
5,665,997 A 9/1997 Weaver et al.
5,699,075 A 12/1997 Miyamoto
5,745,193 A 4/1998 Urbanus et al.
5,745,281 A 4/1998 Yi et al.
5,754,160 A 5/1998 Shimizu et al.
5,771,116 A 6/1998 Miller et al.
5,784,189 A 7/1998 Bozler et al.
5,784,212 A 7/1998 Hornbeck
5,808,780 A 9/1998 McDonald
5,818,095 A 10/1998 Sampsell
5,828,367 A 10/1998 Kuga
5,835,255 A 11/1998 Miles
5,842,088 A 11/1998 Thompson
5,867,302 A 2/1999 Fleming et al.
5,912,758 A 6/1999 Knipe et al.
5,943,158 A 8/1999 Ford et al.
5,959,763 A 9/1999 Bozler et al.
5,966,235 A 10/1999 Walker et al.
5,986,796 A 11/1999 Miles
6,028,690 A 2/2000 Carter et al.
6,038,056 A 3/2000 Florence et al.
6,040,937 A 3/2000 Miles
6,049,317 A 4/2000 Thompson et al.
6,055,090 A 4/2000 Miles
6,061,075 A 5/2000 Nelson et al.
6,099,132 A 8/2000 Kaeriyama
6,100,872 A 8/2000 Aratani et al.
6,113,239 A 9/2000 Sampsell et al.
6,147,790 A 11/2000 Meier et al.
6,160,833 A 12/2000 Floyd et al.
6,178,338 B1 1/2001 Yamagishi et al. ..... 455/566
6,180,428 B1 1/2001 Peeters et al.
6,201,633 B1 3/2001 Peeters et al.
6,232,936 B1 5/2001 Gove et al.
6,275,326 B1 8/2001 Bhalla et al.
6,282,010 B1 8/2001 Sulzbach et al.
6,295,154 B1 9/2001 Laor et al.
6,304,297 B1 10/2001 Swan
6,323,982 B1 11/2001 Hornbeck
6,327,071 B1 12/2001 Kimura
6,356,085 B1 3/2002 Ryat et al.
6,356,254 B1 3/2002 Kimura
6,429,601 B1 8/2002 Friend et al.
6,433,917 B1 8/2002 Mei et al.
6,447,126 B1 9/2002 Hornbeck
6,465,355 B1 10/2002 Horsley
6,466,358 B2 10/2002 Tew
6,473,274 B1 10/2002 Maimone et al.
6,480,177 B2 11/2002 Doherty et al.
6,496,122 B2 12/2002 Sampsell
6,501,107 B1 12/2002 Sinclair et al.
6,507,330 B1 1/2003 Handschy et al.
6,507,331 B1 1/2003 Schlangen et al.
6,545,335 B1 4/2003 Chua et al.
6,548,908 B2 4/2003 Chua et al.
6,549,338 B1 4/2003 Wolverton et al.
6,552,840 B2 4/2003 Knipe
6,574,033 B1 6/2003 Chui et al.
6,589,625 B1 7/2003 Kothari et al.
6,593,934 B1 7/2003 Liaw et al.

| | | | |
|---|---|---|---|
| 6,600,201 | B2 | 7/2003 | Hartwell et al. |
| 6,606,175 | B1 | 8/2003 | Sampsell et al. |
| 6,625,047 | B2 | 9/2003 | Coleman, Jr. |
| 6,630,786 | B2 | 10/2003 | Cummings et al. |
| 6,632,698 | B2 | 10/2003 | Ives |
| 6,636,187 | B2 | 10/2003 | Tajima et al. |
| 6,643,069 | B2 | 11/2003 | Dewald |
| 6,650,455 | B2 | 11/2003 | Miles |
| 6,666,561 | B1 | 12/2003 | Blakley |
| 6,674,090 | B1 | 1/2004 | Chua et al. |
| 6,674,562 | B1 | 1/2004 | Miles |
| 6,680,792 | B2 | 1/2004 | Miles |
| 6,710,908 | B2 | 3/2004 | Miles et al. |
| 6,741,377 | B2 | 5/2004 | Miles |
| 6,741,384 | B1 | 5/2004 | Martin et al. |
| 6,741,503 | B1 | 5/2004 | Farris et al. |
| 6,747,785 | B2 | 6/2004 | Chen et al. |
| 6,762,873 | B1 | 7/2004 | Coker et al. |
| 6,775,174 | B2 | 8/2004 | Huffman et al. |
| 6,778,155 | B2 | 8/2004 | Doherty et al. |
| 6,781,643 | B1 | 8/2004 | Watanabe et al. |
| 6,787,384 | B2 | 9/2004 | Okumura |
| 6,787,438 | B1 | 9/2004 | Nelson |
| 6,788,520 | B1 | 9/2004 | Behin et al. |
| 6,794,119 | B2 | 9/2004 | Miles |
| 6,811,267 | B1 | 11/2004 | Allen et al. |
| 6,813,060 | B1 | 11/2004 | Garcia et al. |
| 6,819,469 | B1 | 11/2004 | Koba |
| 6,822,628 | B2 | 11/2004 | Dunphy et al. |
| 6,829,132 | B2 | 12/2004 | Martin et al. |
| 6,853,129 | B1 | 2/2005 | Cummings et al. |
| 6,855,610 | B2 | 2/2005 | Tung et al. |
| 6,859,218 | B1 | 2/2005 | Luman et al. |
| 6,861,277 | B1 | 3/2005 | Monroe et al. |
| 6,862,022 | B2 | 3/2005 | Slupe |
| 6,862,029 | B1 | 3/2005 | D'Souza et al. |
| 6,867,896 | B2 | 3/2005 | Miles |
| 6,870,581 | B2 | 3/2005 | Li et al. |
| 6,903,860 | B2 | 6/2005 | Ishii |
| 7,012,600 | B2 | 3/2006 | Zehner et al. |
| 7,034,783 | B2 | 4/2006 | Gates et al. |
| 7,400,489 | B2 | 7/2008 | Van Brocklin et al. |
| 2001/0003487 | A1 | 6/2001 | Miles |
| 2001/0026250 | A1 | 10/2001 | Inoue et al. |
| 2001/0034075 | A1 | 10/2001 | Onoya |
| 2001/0040536 | A1 | 11/2001 | Tajima et al. |
| 2001/0043171 | A1 | 11/2001 | Van Gorkom et al. |
| 2001/0046081 | A1 | 11/2001 | Hayashi et al. |
| 2001/0051014 | A1 | 12/2001 | Behin et al. |
| 2001/0052887 | A1 | 12/2001 | Tsutsui et al. |
| 2002/0000959 | A1 | 1/2002 | Colgan et al. |
| 2002/0005827 | A1 | 1/2002 | Kobayashi |
| 2002/0012159 | A1 | 1/2002 | Tew |
| 2002/0015215 | A1 | 2/2002 | Miles |
| 2002/0024711 | A1 | 2/2002 | Miles |
| 2002/0036304 | A1 | 3/2002 | Ehmke et al. |
| 2002/0050882 | A1 | 5/2002 | Hyman et al. |
| 2002/0054424 | A1 | 5/2002 | Miles |
| 2002/0075226 | A1 | 6/2002 | Lippincott |
| 2002/0075555 | A1 | 6/2002 | Miles |
| 2002/0093722 | A1 | 7/2002 | Chan et al. |
| 2002/0097133 | A1 | 7/2002 | Charvet et al. |
| 2002/0126364 | A1 | 9/2002 | Miles |
| 2002/0179421 | A1 | 12/2002 | Williams et al. |
| 2002/0186108 | A1 | 12/2002 | Hallbjorner |
| 2003/0004272 | A1 | 1/2003 | Power |
| 2003/0020699 | A1 | 1/2003 | Nakatani et al. |
| 2003/0043157 | A1 | 3/2003 | Miles |
| 2003/0072070 | A1 | 4/2003 | Miles |
| 2003/0122773 | A1 | 7/2003 | Washio et al. |
| 2003/0137215 | A1 | 7/2003 | Cabuz |
| 2003/0137521 | A1 | 7/2003 | Zehner et al. |
| 2003/0189536 | A1 | 10/2003 | Ruigt |
| 2003/0202264 | A1 | 10/2003 | Weber et al. |
| 2003/0202265 | A1 | 10/2003 | Reboa et al. |
| 2003/0202266 | A1 | 10/2003 | Ring et al. |
| 2004/0008396 | A1 | 1/2004 | Stappaerts |
| 2004/0021658 | A1 | 2/2004 | Chen |
| 2004/0022044 | A1 | 2/2004 | Yasuoka et al. |
| 2004/0027701 | A1 | 2/2004 | Ishikawa |
| 2004/0051929 | A1 | 3/2004 | Sampsell et al. |
| 2004/0058532 | A1 | 3/2004 | Miles et al. |
| 2004/0080807 | A1 | 4/2004 | Chen et al. |
| 2004/0136596 | A1 | 7/2004 | Oneda et al. |
| 2004/0145049 | A1 | 7/2004 | McKinnell et al. |
| 2004/0145553 | A1 | 7/2004 | Sala et al. |
| 2004/0147056 | A1 | 7/2004 | McKinnell et al. |
| 2004/0160143 | A1 | 8/2004 | Shreeve et al. |
| 2004/0174583 | A1 | 9/2004 | Chen et al. |
| 2004/0179281 | A1 | 9/2004 | Reboa |
| 2004/0212026 | A1 | 10/2004 | Van Brocklin et al. |
| 2004/0217378 | A1 | 11/2004 | Martin et al. |
| 2004/0217919 | A1 | 11/2004 | Pichl et al. |
| 2004/0218251 | A1 | 11/2004 | Piehl et al. |
| 2004/0218334 | A1 | 11/2004 | Martin et al. |
| 2004/0218341 | A1 | 11/2004 | Martin et al. |
| 2004/0223204 | A1 | 11/2004 | Mao et al. |
| 2004/0227493 | A1 | 11/2004 | Van Brocklin et al. |
| 2004/0240032 | A1 | 12/2004 | Miles |
| 2004/0240138 | A1 | 12/2004 | Martin et al. |
| 2004/0245588 | A1 | 12/2004 | Nikkel et al. |
| 2004/0263944 | A1 | 12/2004 | Miles et al. |
| 2005/0001828 | A1 | 1/2005 | Martin et al. |
| 2005/0012577 | A1 | 1/2005 | Pillans et al. |
| 2005/0024301 | A1 | 2/2005 | Funston |
| 2005/0038950 | A1 | 2/2005 | Adelmann |
| 2005/0057442 | A1 | 3/2005 | Way |
| 2005/0068583 | A1 | 3/2005 | Gutkowski et al. |
| 2005/0069209 | A1 | 3/2005 | Damera-Venkata et al. |
| 2005/0116924 | A1 | 6/2005 | Sauvante et al. |
| 2005/0174356 | A1* | 8/2005 | Paterson ..... 345/567 |
| 2005/0206991 | A1 | 9/2005 | Chui et al. |
| 2005/0286113 | A1 | 12/2005 | Miles |
| 2005/0286114 | A1 | 12/2005 | Miles |
| 2006/0044246 | A1 | 3/2006 | Mignard |
| 2006/0044298 | A1 | 3/2006 | Mignard et al. |
| 2006/0044928 | A1 | 3/2006 | Chui et al. |
| 2006/0056000 | A1 | 3/2006 | Mignard |
| 2006/0057754 | A1 | 3/2006 | Cummings |
| 2006/0066542 | A1 | 3/2006 | Chui |
| 2006/0066559 | A1 | 3/2006 | Chui et al. |
| 2006/0066560 | A1 | 3/2006 | Gally et al. |
| 2006/0066561 | A1 | 3/2006 | Chui et al. |
| 2006/0066594 | A1 | 3/2006 | Tyger |
| 2006/0066597 | A1 | 3/2006 | Sampsell |
| 2006/0066598 | A1 | 3/2006 | Floyd |
| 2006/0066601 | A1 | 3/2006 | Kothari |
| 2006/0066937 | A1 | 3/2006 | Chui |
| 2006/0066938 | A1 | 3/2006 | Chui |
| 2006/0067648 | A1 | 3/2006 | Chui et al. |
| 2006/0067653 | A1 | 3/2006 | Gally et al. |
| 2006/0077127 | A1 | 4/2006 | Sampsell et al. |
| 2006/0077505 | A1 | 4/2006 | Chui et al. |
| 2006/0077520 | A1 | 4/2006 | Chui et al. |
| 2006/0103613 | A1 | 5/2006 | Chui |
| 2006/0250335 | A1 | 11/2006 | Stewart et al. |
| 2009/0219309 | A1 | 9/2009 | Sampsell |
| 2009/0219600 | A1 | 9/2009 | Gally et al. |
| 2009/0225069 | A1 | 9/2009 | Sampsell |
| 2009/0273596 | A1 | 11/2009 | Cummings |
| 2010/0026680 | A1 | 2/2010 | Chui et al. |

FOREIGN PATENT DOCUMENTS

| | | | |
|---|---|---|---|
| EP | 0300754 | A2 | 1/1989 |
| EP | 0306308 | A2 | 3/1989 |
| EP | 0318050 | A | 5/1989 |
| EP | 0 417 523 | A | 3/1991 |
| EP | 0 467 048 | A | 1/1992 |
| EP | 0570906 | A | 11/1993 |
| EP | 0608056 | A1 | 7/1994 |
| EP | 0655725 | A1 | 5/1995 |
| EP | 0667548 | A1 | 8/1995 |
| EP | 0725380 | A1 | 8/1996 |
| EP | 0852371 | A1 | 7/1998 |
| EP | 0911794 | A1 | 4/1999 |
| EP | 0 017 038 | A | 7/2000 |
| EP | 1 134 721 | | 9/2001 |
| EP | 1146533 | A | 10/2001 |

| | | | |
|---|---|---|---|
| EP | 1 239 448 | | 9/2002 |
| EP | 1 280 129 | | 1/2003 |
| EP | 1343190 | A | 9/2003 |
| EP | 1345197 | A | 9/2003 |
| EP | 1381023 | A | 1/2004 |
| EP | 1473691 | A2 | 11/2004 |
| GB | 2401200 | A | 11/2004 |
| JP | 2000-075963 | | 4/2000 |
| JP | 2004-29571 | | 1/2004 |
| WO | WO 95/30924 | | 11/1995 |
| WO | WO 97/17628 | | 5/1997 |
| WO | WO 99/52006 | A3 | 10/1999 |
| WO | WO 01/73937 | A | 10/2001 |
| WO | WO 02/089103 | | 11/2002 |
| WO | WO 03/007049 | A1 | 1/2003 |
| WO | WO 03/015071 | A2 | 2/2003 |
| WO | WO 03/044765 | A2 | 5/2003 |
| WO | WO 03/060940 | A | 7/2003 |
| WO | WO 03/069413 | A1 | 8/2003 |
| WO | WO 03/073151 | A1 | 9/2003 |
| WO | WO 03/079323 | A | 9/2003 |
| WO | WO 03/090199 | A1 | 10/2003 |
| WO | WO 2004/006003 | A1 | 1/2004 |
| WO | WO 2004/026757 | A | 4/2004 |
| WO | WO 2004/049034 | A1 | 6/2004 |
| WO | WO 2004/054088 | | 6/2004 |

OTHER PUBLICATIONS

Chen et al., Low peak current driving scheme for passive matrix-OLED, SID International Symposium Digest of Technical Papers, May 2003, pp. 504-507.

International Preliminary Report on Patentability dated Jun. 4, 2007.

Bains, "Digital Paper Display Technology holds Promise for Portables", CommsDesign EE Times (2000).

Lieberman, "MEMS Display Looks to give PDAs Sharper Image" EE Times (2004).

Lieberman, "Microbridges at heart of new MEMS displays" EE Times (2004).

Peroulis et al., Low contact resistance series MEMS switches, 2002, pp. 223-226, vol. 1, IEEE MTT-S International Microwave Symposium Digest, New York, NY.

Seeger et al., "Stabilization of Electrostatically Actuated Mechanical Devices", (1997) International Conference on Solid State Sensors and Actuators; vol. 2, pp. 1133-1136.

Office Action dated Jul. 10, 2009 in Chinese App. No. 200680023322.1.

Office Action dated Jan. 20, 2010 in Chinese App. No. 200680023322.1.

Office Action cited in corresponding European Patent Application No. 06751412.5 dated Sep. 1, 2010.

Official Communication dated Feb. 12, 2010 in European App. No. 06751412.5.

Office Action dated Sep. 30, 2010 in Chinese App. No. 200680023322.1.

* cited by examiner

| | | Column Output Signals | |
|---|---|---|---|
| | | $+V_{bias}$ | $-V_{bias}$ |
| Row Output Signals | 0 | Stable | Stable |
| | $+\Delta V$ | Release | Actuate |
| | $-\Delta V$ | Actuate | Release |

SYSTEMS AND METHODS OF ACTUATING MEMS DISPLAY ELEMENTS

CROSS REFERENCE TO RELATED APPLICATIONS

This application claims priority under 35 U.S.C. Section 119(e) to U.S. Provisional Patent Application 60/678,473 filed on May 5, 2005, which application is hereby incorporated by reference in its entirety.

BACKGROUND

Microelectromechanical systems (MEMS) include micro mechanical elements, actuators, and electronics. Micromechanical elements may be created using deposition, etching, and or other micromachining processes that etch away parts of substrates and/or deposited material layers or that add layers to form electrical and electromechanical devices. One type of MEMS device is called an interferometric modulator. As used herein, the term interferometric modulator or interferometric light modulator refers to a device that selectively absorbs and/or reflects light using the principles of optical interference. In certain embodiments, an interferometric modulator may comprise a pair of conductive plates, one or both of which may be transparent and/or reflective in whole or part and capable of relative motion upon application of an appropriate electrical signal. In a particular embodiment, one plate may comprise a stationary layer deposited on a substrate and the other plate may comprise a metallic membrane separated from the stationary layer by an air gap. As described herein in more detail, the position of one plate in relation to another can change the optical interference of light incident on the interferometric modulator. Such devices have a wide range of applications, and it would be beneficial in the art to utilize and/or modify the characteristics of these types of devices so that their features can be exploited in improving existing products and creating new products that have not yet been developed.

SUMMARY

The system, method, and devices of the invention each have several aspects, no single one of which is solely responsible for its desirable attributes. Without limiting the scope of this invention, its more prominent features will now be discussed briefly. After considering this discussion, and particularly after reading the section entitled "Detailed Description of Certain Embodiments" one will understand how the features of this invention provide advantages over other display devices.

In one embodiment, the invention comprises a method of writing image data to a display array comprising pixels that exhibit two different states. The method includes sequentially writing a plurality of rows of image data to a selected row of the display array, the plurality of rows of image data corresponding to image data for the row in a plurality of frames of image data being sequentially written to the array. Prior to writing each row of a first portion of the plurality of rows of image data to the selected row, substantially all of the pixels are placed in the first state. Prior to writing each row of a second, different portion of the plurality of rows of image data to the selected row, substantially all of the pixels are placed in the second state.

In another embodiment, a display apparatus includes a display array comprising display elements that exhibit two different states, and a driver circuit configured to write rows of image data to at least one row of the display array. The driver circuit is further configured to select from a set of at least two pre-write operations to be performed prior to writing a row of image data to the row. A first of the pre-write operations places substantially all of the display elements in the row into a first state. A second of the pre-write operations places substantially all of the display elements into a second state.

In another embodiment, a display apparatus includes means for displaying image data on an array of pixels and means for writing rows of image data to at least one row of the displaying means. The apparatus further includes means for selecting from a set of at least two pre-write operations to be performed prior to writing a row of image data to the row. A first of the pre-write operations places substantially all of the display elements in the row into a first state, and a second of the pre-write operations places substantially all of the display elements into a second state.

DETAILED DESCRIPTION

The following detailed description is directed to certain specific embodiments of the invention. However, the invention can be embodied in a multitude of different ways. In this description, reference is made to the drawings wherein like parts are designated with like numerals throughout. As will be apparent from the following description, the embodiments may be implemented in any device that is configured to display an image, whether in motion (e.g., video) or stationary (e.g., still image), and whether textual or pictorial. More particularly, it is contemplated that the embodiments may be implemented in or associated with a variety of electronic devices such as, but not limited to, mobile telephones, wireless devices, personal data assistants (PDAs), hand-held or portable computers, GPS receivers/navigators, cameras, MP3 players, camcorders, game consoles, wrist watches, clocks, calculators, television monitors, flat panel displays, computer monitors, auto displays (e.g., odometer display, etc.), cockpit controls and/or displays, display of camera views (e.g., display of a rear view camera in a vehicle), electronic photographs, electronic billboards or signs, projectors, architectural structures, packaging, and aesthetic structures (e.g., display of images on a piece of jewelry). MEMS devices of similar structure to those described herein can also be used in non-display applications such as in electronic switching devices.

As described herein, advantageous methods of driving the displays to display data can help improve display lifetime and performance. In some embodiments, pixels of the display are cleared or actuated prior to writing data to them.

Figure 1:
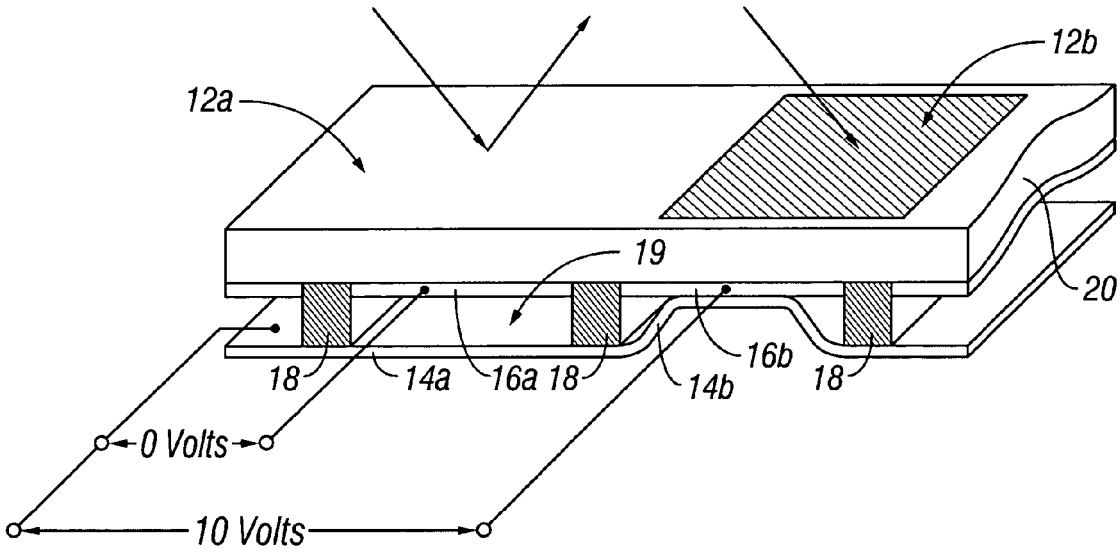
FIG. 1 is an isometric view depicting a portion of one embodiment of an interferometric modulator display in which a movable reflective layer of a first interferometric modulator is in a relaxed position and a movable reflective layer of a second interferometric modulator is in an actuated position.

One interferometric modulator display embodiment comprising an interferometric MEMS display element is illustrated in FIG. 1. In these devices, the pixels are in either a bright or dark state. In the bright ("on" or "open") state, the display element reflects a large portion of incident visible light to a user. When in the dark ("off" or "closed") state, the display element reflects little incident visible light to the user. Depending on the embodiment, the light reflectance properties of the "on" and "off" states may be reversed. MEMS pixels can be configured to reflect predominantly at selected colors, allowing for a color display in addition to black and white.

FIG. 1 is an isometric view depicting two adjacent pixels in a series of pixels of a visual display, wherein each pixel comprises a MEMS interferometric modulator. In some embodiments, an interferometric modulator display comprises a row/column array of these interferometric modulators. Each interferometric modulator includes a pair of reflective layers positioned at a variable and controllable distance from each other to form a resonant optical cavity with at least one variable dimension. In one embodiment, one of the reflective layers may be moved between two positions. In the first position, referred to herein as the relaxed position, the movable reflective layer is positioned at a relatively large distance from a fixed partially reflective layer. In the second position, referred to herein as the actuated position, the movable reflective layer is positioned more closely adjacent to the partially reflective layer. Incident light that reflects from the two layers interferes constructively or destructively depending on the position of the movable reflective layer, producing either an overall reflective or non-reflective state for each pixel.

The depicted portion of the pixel array in FIG. 1 includes two adjacent interferometric modulators 12*a* and 12*b*. In the interferometric modulator 12*a* on the left, a movable reflective layer 14*a* is illustrated in a relaxed position at a predetermined distance from an optical stack 16*a*, which includes a partially reflective layer. In the interferometric modulator 12*b* on the right, the movable reflective layer 14*b* is illustrated in an actuated position adjacent to the optical stack 16*b*.

The optical stacks 16*a* and 16*b* (collectively referred to as optical stack 16), as referenced herein, typically comprise of several fused layers, which can include an electrode layer, such as indium tin oxide (ITO), a partially reflective layer, such as chromium, and a transparent dielectric. The optical stack 16 is thus electrically conductive, partially transparent and partially reflective, and may be fabricated, for example, by depositing one or more of the above layers onto a transparent substrate 20. In some embodiments, the layers are patterned into parallel strips, and may form row electrodes in a display device as described further below. The movable reflective layers 14*a*, 14*b* may be formed as a series of parallel strips of a deposited metal layer or layers (orthogonal to the row electrodes of 16*a*, 16*b*) deposited on top of posts 18 and an intervening sacrificial material deposited between the posts 18. When the sacrificial material is etched away, the movable reflective layers 14*a*, 14*b* are separated from the optical stacks 16*a*, 16*b* by a defined gap 19. A highly conductive and reflective material such as aluminum may be used for the reflective layers 14, and these strips may form column electrodes in a display device.

With no applied voltage, the cavity 19 remains between the movable reflective layer 14*a* and optical stack 16*a*, with the movable reflective layer 14*a* in a mechanically relaxed state, as illustrated by the pixel 12*a* in FIG. 1. However, when a potential difference is applied to a selected row and column, the capacitor formed at the intersection of the row and column electrodes at the corresponding pixel becomes charged, and electrostatic forces pull the electrodes together. If the voltage is high enough, the movable reflective layer 14 is deformed and is forced against the optical stack 16. A dielectric layer (not illustrated in this Figure) within the optical stack 16 may prevent shorting and control the separation distance between layers 14 and 16, as illustrated by pixel 12*b* on the right in FIG. 1. The behavior is the same regardless of the polarity of the applied potential difference. In this way, row/column actuation that can control the reflective vs. non-reflective pixel states is analogous in many ways to that used in conventional LCD and other display technologies.

FIGS. 2 through 5 illustrate one exemplary process and system for using an array of interferometric modulators in a display application.

Figure 2:
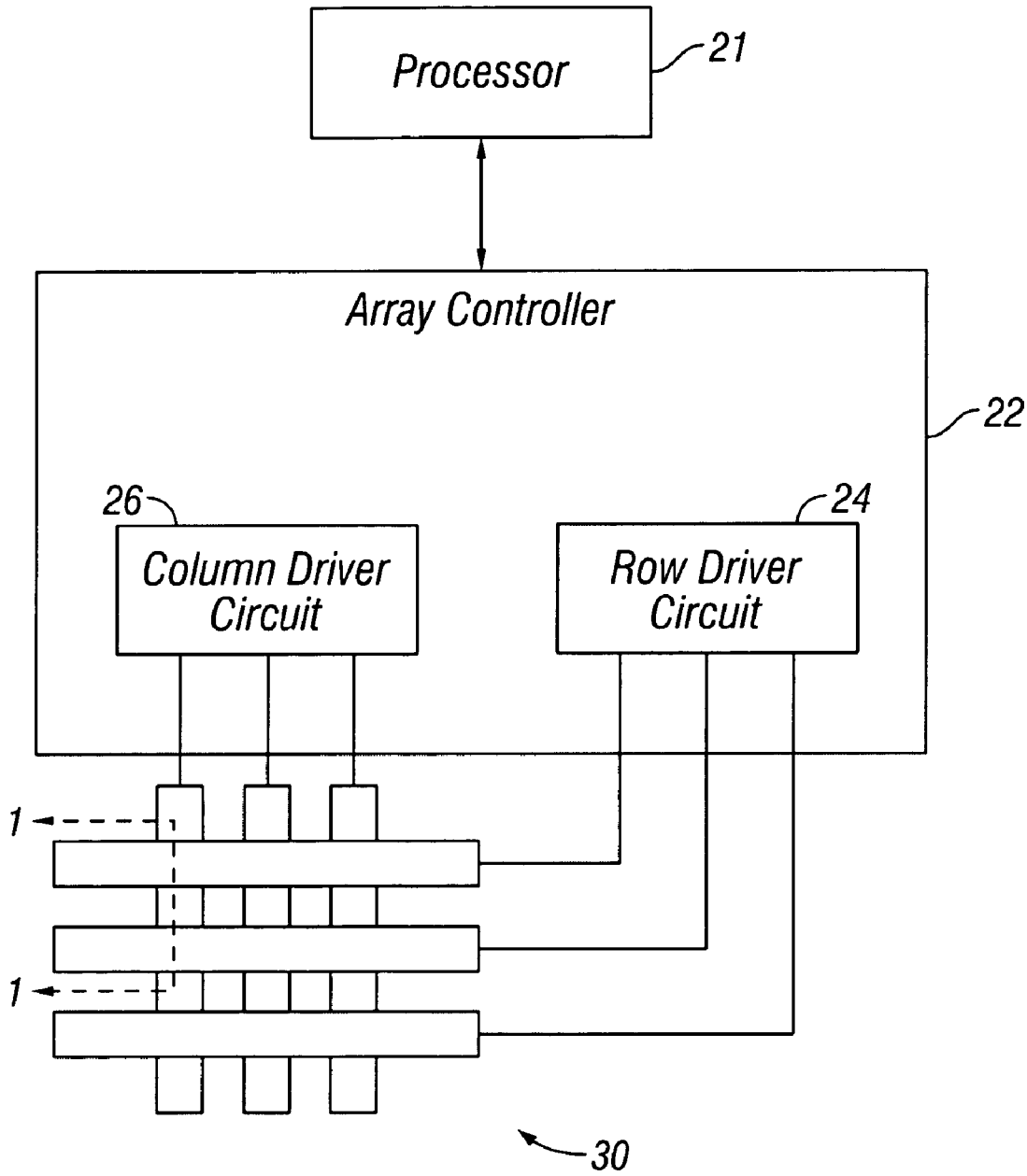
FIG. 2 is a system block diagram illustrating one embodiment of an electronic device incorporating a 3×3 interferometric modulator display.

FIG. 2 is a system block diagram illustrating one embodiment of an electronic device that may incorporate aspects of the invention. In the exemplary embodiment, the electronic device includes a processor 21 which may be any general purpose single- or multi-chip microprocessor such as an ARM, Pentium®, Pentium II®, Pentium III®, Pentium IV®, Pentium® Pro, an 8051, a MIPS®, a Power PC®, an ALPHA®, or any special purpose microprocessor such as a digital signal processor, microcontroller, or a programmable gate array. As is conventional in the art, the processor 21 may be configured to execute one or more software modules. In addition to executing an operating system, the processor may be configured to execute one or more software applications, including a web browser, a telephone application, an email program, or any other software application.

In one embodiment, the processor 21 is also configured to communicate with an array driver 22. In one embodiment, the array driver 22 includes a row driver circuit 24 and a column driver circuit 26 that provide signals to a panel or display array (display) 30. The cross section of the array illustrated in FIG. 1 is shown by the lines 1-1 in FIG. 2. For MEMS interferometric modulators, the row/column actuation protocol may take advantage of a hysteresis property of these devices illustrated in FIG. 3. It may require, for example, a 10 volt potential difference to cause a movable layer to deform from the relaxed state to the actuated state. However, when the voltage is reduced from that value, the movable layer maintains its state as the voltage drops back below 10 volts. In the exemplary embodiment of FIG. 3, the movable layer does not relax completely until the voltage drops below 2 volts. There is thus a range of voltage, about 3 to 7 V in the example illustrated in FIG. 3, where there exists a window of applied voltage within which the device is stable in either the relaxed or actuated state. This is referred to herein as the "hysteresis window" or "stability window." For a display array having the hysteresis characteristics of FIG. 3, the row/column actuation protocol can be designed such that during row strobing, pixels in the strobed row that are to be actuated are exposed to a voltage difference of about 10 volts, and pixels that are to be relaxed are exposed to a voltage difference of close to zero volts. After the strobe, the pixels are exposed to a steady state voltage difference of about 5 volts such that they remain in whatever state the row strobe put them in. After being written, each pixel sees a potential difference within the "stability window" of 3-7 volts in this example. This feature makes the pixel design illustrated in FIG. 1 stable under the same applied voltage conditions in either an actuated or relaxed pre-existing state. Since each pixel of the interferometric modulator, whether in the actuated or relaxed state, is essentially a capacitor formed by the fixed and moving reflective layers, this stable state can be held at a voltage within the hysteresis window with almost no power dissipation. Essentially no current flows into the pixel if the applied potential is fixed.

In typical applications, a display frame may be created by asserting the set of column electrodes in accordance with the desired set of actuated pixels in the first row. A row pulse is then applied to the row 1 electrode, actuating the pixels corresponding to the asserted column lines. The asserted set of column electrodes is then changed to correspond to the desired set of actuated pixels in the second row. A pulse is then applied to the row 2 electrode, actuating the appropriate pixels in row 2 in accordance with the asserted column electrodes. The row 1 pixels are unaffected by the row 2 pulse, and remain in the state they were set to during the row 1 pulse. This may be repeated for the entire series of rows in a sequential fashion to produce the frame. Generally, the frames are refreshed and/or updated with new display data by continually repeating this process at some desired number of frames per second. A wide variety of protocols for driving row and column electrodes of pixel arrays to produce display frames are also well known and may be used in conjunction with the present invention.

Figures 3, 4:
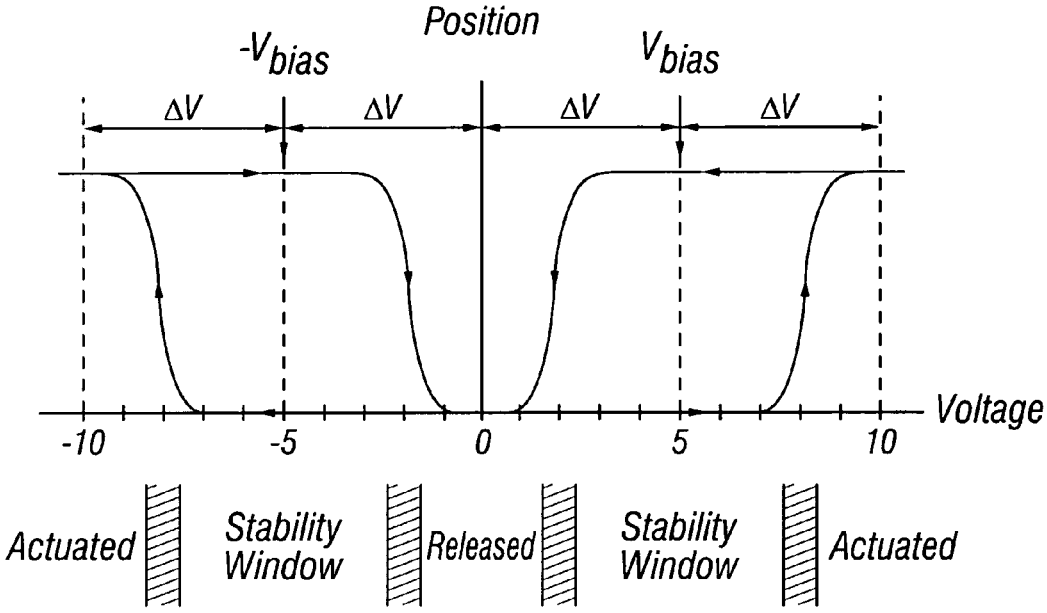
FIG. 3 is a diagram of movable mirror position versus applied voltage for one exemplary embodiment of an interferometric modulator of FIG. 1.
FIG. 4 is an illustration of a set of row and column voltages that may be used to drive an interferometric modulator display.

FIGS. 4 and 5 illustrate one possible actuation protocol for creating a display frame on the 3×3 array of FIG. 2. FIG. 4 illustrates a possible set of column and row voltage levels that may be used for pixels exhibiting the hysteresis curves of FIG. 3. In the FIG. 4 embodiment, actuating a pixel involves setting the appropriate column to $-V_{bias}$, and the appropriate row to $+\Delta V$, which may correspond to −5 volts and +5 volts respectively Relaxing the pixel is accomplished by setting the appropriate column to $+V_{bias}$, and the appropriate row to the same $+\Delta V$, producing a zero volt potential difference across the pixel. In those rows where the row voltage is held at zero volts, the pixels are stable in whatever state they were originally in, regardless of whether the column is at $+V_{bias}$, or $-V_{bias}$. As is also illustrated in FIG. 4, it will be appreciated that voltages of opposite polarity than those described above can be used, e.g., actuating a pixel can involve setting the appropriate column to $+V_{bias}$, and the appropriate row to $-\Delta V$. In this embodiment, releasing the pixel is accomplished by setting the appropriate column to $-V_{bias}$, and the appropriate row to the same $-\Delta V$, producing a zero volt potential difference across the pixel.

Figure 5A:
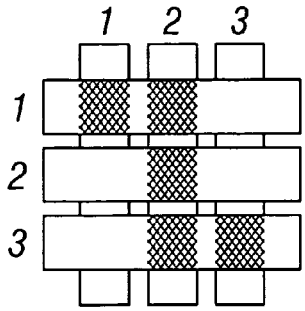
FIGS. 5A and 5B illustrate one exemplary timing diagram for row and column signals that may be used to write a frame of display data to the 3x3 interferometric modulator display of FIG. 2.
Figure 5B:
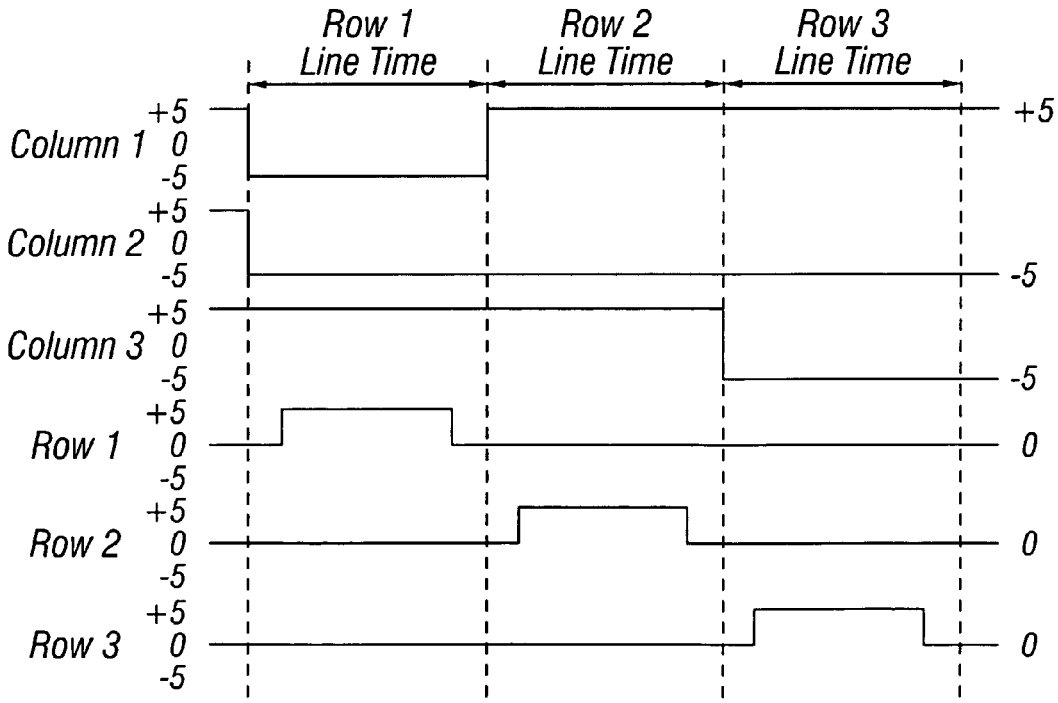

FIG. 5B is a timing diagram showing a series of row and column signals applied to the 3×3 array of FIG. 2 which will result in the display arrangement illustrated in FIG. 5A, where actuated pixels are non-reflective. Prior to writing the frame illustrated in FIG. 5A, the pixels can be in any state, and in this example, all the rows are at 0 volts, and all the columns are at +5 volts. With these applied voltages, all pixels are stable in their existing actuated or relaxed states.

In the FIG. 5A frame, pixels (1,1), (1,2), (2,2), (3,2) and (3,3) are actuated. To accomplish this, during a "line time" for row 1, columns 1 and 2 are set to −5 volts, and column 3 is set to +5 volts. This does not change the state of any pixels, because all the pixels remain in the 3-7 volt stability window. Row 1 is then strobed with a pulse that goes from 0, up to 5 volts, and back to zero. This actuates the (1,1) and (1,2) pixels and relaxes the (1,3) pixel. No other pixels in the array are affected. To set row 2 as desired, column 2 is set to −5 volts, and columns 1 and 3 are set to +5 volts. The same strobe applied to row 2 will then actuate pixel (2,2) and relax pixels (2,1) and (2,3). Again, no other pixels of the array are affected. Row 3 is similarly set by setting columns 2 and 3 to −5 volts, and column 1 to +5 volts. The row 3 strobe sets the row 3 pixels as shown in FIG. 5A. After writing the frame, the row potentials are zero, and the column potentials can remain at either +5 or −5 volts, and the display is then stable in the arrangement of FIG. 5A. It will be appreciated that the same procedure can be employed for arrays of dozens or hundreds of rows and columns. It will also be appreciated that the timing, sequence, and levels of voltages used to perform row and column actuation can be varied widely within the general principles outlined above, and the above example is exemplary only, and any actuation voltage method can be used with the systems and methods described herein.

Figure 6A:
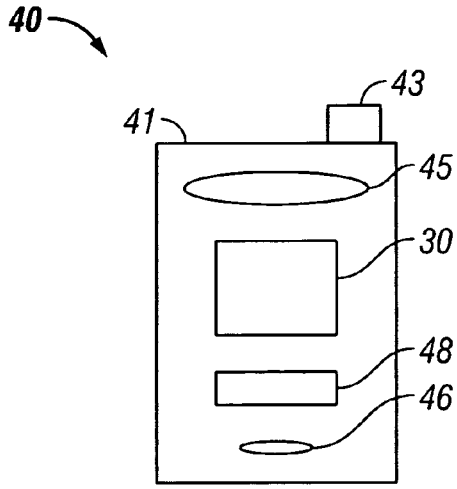
FIGS. 6A and 6B are system block diagrams illustrating an embodiment of a visual display device comprising a plurality of interferometric modulators.
Figure 6B:
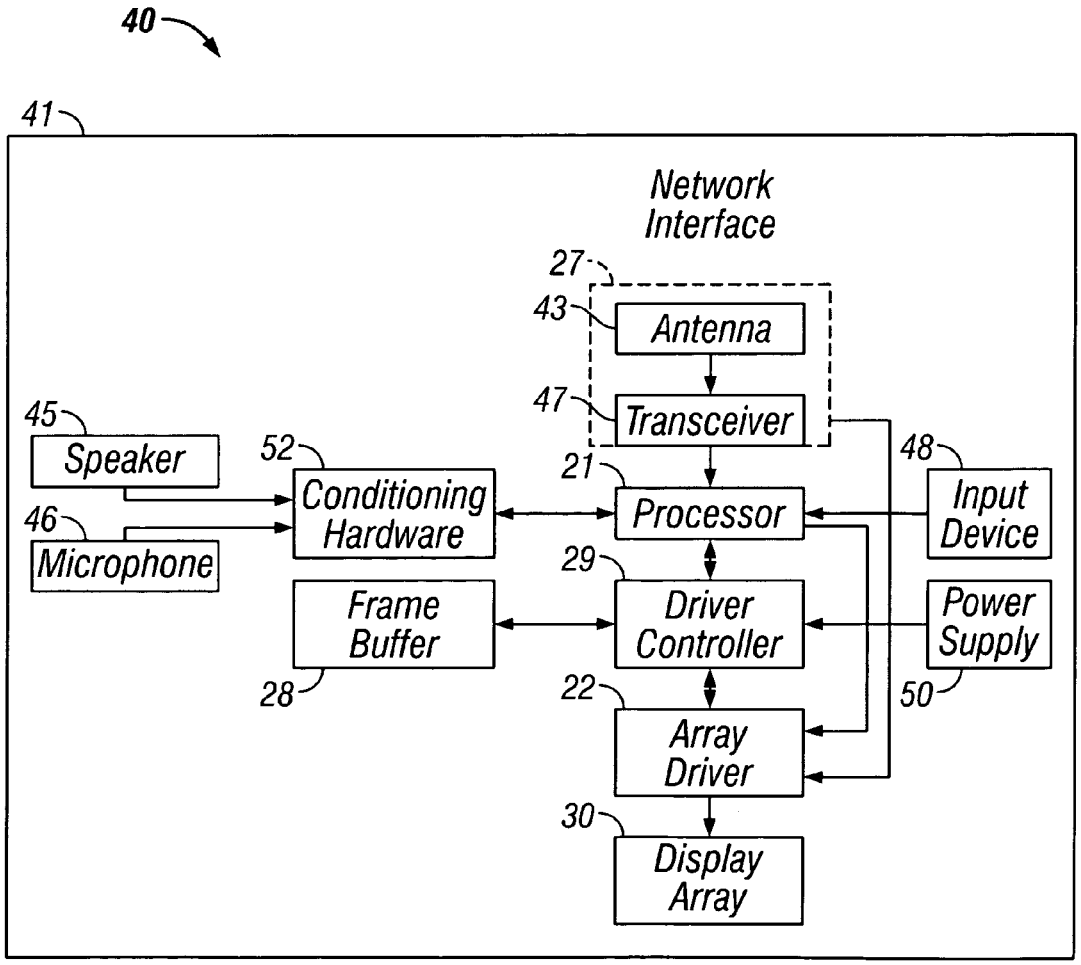

FIGS. 6A and 6B are system block diagrams illustrating an embodiment of a display device 40. The display device 40 can be, for example, a cellular or mobile telephone. However, the same components of display device 40 or slight variations thereof are also illustrative of various types of display devices such as televisions and portable media players.

The display device 40 includes a housing 41, a display 30, an antenna 43, a speaker 45, an input device 48, and a microphone 46. The housing 41 is generally formed from any of a variety of manufacturing processes as are well known to those of skill in the art, including injection molding, and vacuum forming. In addition, the housing 41 may be made from any of a variety of materials, including but not limited to plastic, metal, glass, rubber, and ceramic, or a combination thereof. In one embodiment the housing 41 includes removable portions (not shown) that may be interchanged with other removable portions of different color, or containing different logos, pictures, or symbols.

The display 30 of exemplary display device 40 may be any of a variety of displays, including a bi-stable display, as described herein. In other embodiments, the display 30 includes a flat-panel display, such as plasma, EL, OLED, STN LCD, or TFT LCD as described above, or a non-flat-panel display, such as a CRT or other tube device, as is well known to those of skill in the art. However, for purposes of describing the present embodiment, the display 30 includes an interferometric modulator display, as described herein.

The components of one embodiment of exemplary display device 40 are schematically illustrated in FIG. 6B. The illustrated exemplary display device 40 includes a housing 41 and can include additional components at least partially enclosed therein. For example, in one embodiment, the exemplary display device 40 includes a network interface 27 that includes an antenna 43 which is coupled to a transceiver 47.

The transceiver 47 is connected to the processor 21, which is connected to conditioning hardware 52. The conditioning hardware 52 may be configured to condition a signal (e.g. filter a signal). The conditioning hardware 52 is connected to a speaker 45 and a microphone 46. The processor 21 is also connected to an input device 48 and a driver controller 29. The driver controller 29 is coupled to a frame buffer 28 and to the array driver 22, which in turn is coupled to a display array 30. A power supply 50 provides power to all components as required by the particular exemplary display device 40 design.

The network interface 27 includes the antenna 43 and the transceiver 47 so that the exemplary display device 40 can communicate with one ore more devices over a network. In one embodiment the network interface 27 may also have some processing capabilities to relieve requirements of the processor 21. The antenna 43 is any antenna known to those of skill in the art for transmitting and receiving signals. In one embodiment, the antenna transmits and receives RF signals according to the IEEE 802.11 standard, including IEEE 802.11(a), (b), or (g). In another embodiment, the antenna transmits and receives RF signals according to the BLUETOOTH standard. In the case of a cellular telephone, the antenna is designed to receive CDMA, GSM, AMPS or other known signals that are used to communicate within a wireless cell phone network. The transceiver 47 pre-processes the signals received from the antenna 43 so that they may be received by and further manipulated by the processor 21. The transceiver 47 also processes signals received from the processor 21 so that they may be transmitted from the exemplary display device 40 via the antenna 43.

In an alternative embodiment, the transceiver 47 can be replaced by a receiver. In yet another alternative embodiment, network interface 27 can be replaced by an image source, which can store or generate image data to be sent to the processor 21. For example, the image source can be a digital video disc (DVD) or a hard-disc drive that contains image data, or a software module that generates image data.

Processor 21 generally controls the overall operation of the exemplary display device 40. The processor 21 receives data, such as compressed image data from the network interface 27 or an image source, and processes the data into raw image data or into a format that is readily processed into raw image data. The processor 21 then sends the processed data to the driver controller 29 or to frame buffer 28 for storage. Raw data typically refers to the information that identifies the image characteristics at each location within an image. For example, such image characteristics can include color, saturation, and gray-scale level.

In one embodiment, the processor 21 includes a microcontroller, CPU, or logic unit to control operation of the exemplary display device 40. Conditioning hardware 52 generally includes amplifiers and filters for transmitting signals to the speaker 45, and for receiving signals from the microphone 46. Conditioning hardware 52 may be discrete components within the exemplary display device 40, or may be incorporated within the processor 21 or other components.

The driver controller 29 takes the raw image data generated by the processor 21 either directly from the processor 21 or from the frame buffer 28 and reformats the raw image data appropriately for high speed transmission to the array driver 22. Specifically, the driver controller 29 reformats the raw image data into a data flow having a raster-like format, such that it has a time order suitable for scanning across the display array 30. Then the driver controller 29 sends the formatted information to the array driver 22. Although a driver controller 29, such as a LCD controller, is often associated with the system processor 21 as a stand-alone Integrated Circuit (IC), such controllers may be implemented in many ways. They may be embedded in the processor 21 as hardware, embedded in the processor 21 as software, or fully integrated in hardware with the array driver 22.

Typically, the array driver 22 receives the formatted information from the driver controller 29 and reformats the video data into a parallel set of waveforms that are applied many times per second to the hundreds and sometimes thousands of leads coming from the display's x-y matrix of pixels.

In one embodiment, the driver controller 29, array driver 22, and display array 30 are appropriate for any of the types of displays described herein. For example, in one embodiment, driver controller 29 is a conventional display controller or a bi-stable display controller (e.g., an interferometric modulator controller). In another embodiment, array driver 22 is a conventional driver or a bi-stable display driver (e.g., an interferometric modulator display). In one embodiment, a driver controller 29 is integrated with the array driver 22. Such an embodiment is common in highly integrated systems such as cellular phones, watches, and other small area displays. In yet another embodiment, display array 30 is a typical display array or a bi-stable display array (e.g., a display including an array of interferometric modulators).

The input device 48 allows a user to control the operation of the exemplary display device 40. In one embodiment, input device 48 includes a keypad, such as a QWERTY keyboard or a telephone keypad, a button, a switch, a touch-sensitive screen, a pressure- or heat-sensitive membrane. In one embodiment, the microphone 46 is an input device for the exemplary display device 40. When the microphone 46 is used to input data to the device, voice commands may be provided by a user for controlling operations of the exemplary display device 40.

Power supply 50 can include a variety of energy storage devices as are well known in the art. For example, in one embodiment, power supply 50 is a rechargeable battery, such as a nickel-cadmium battery or a lithium ion battery. In another embodiment, power supply 50 is a renewable energy source, a capacitor, or a solar cell, including a plastic solar cell, and solar-cell paint. In another embodiment, power supply 50 is configured to receive power from a wall outlet.

In some implementations control programmability resides, as described above, in a driver controller which can be located in several places in the electronic display system. In some cases control programmability resides in the array driver 22. Those of skill in the art will recognize that the above-described optimization may be implemented in any number of hardware and/or software components and in various configurations.

Figure 7A:
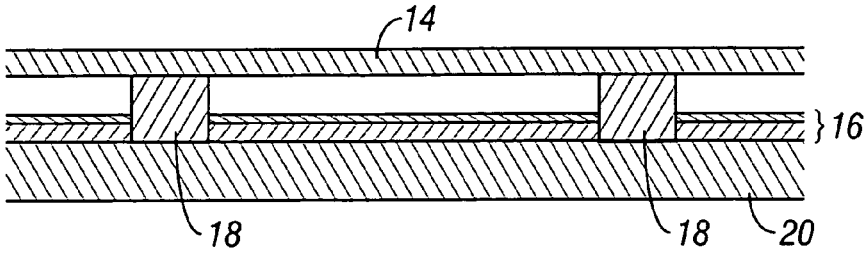
FIG. 7A is a cross section of the device of FIG. 1.
Figure 7B:
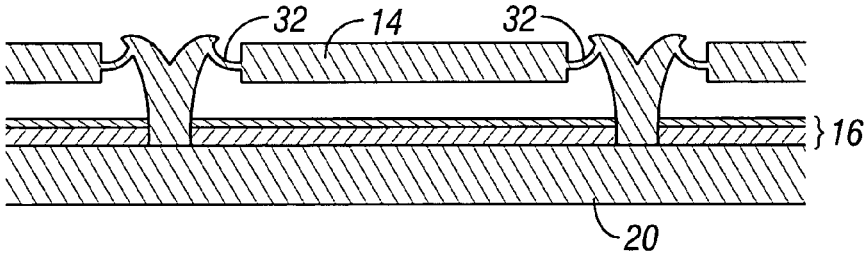
FIG. 7B is a cross section of an alternative embodiment of an interferometric modulator.
Figure 7C:
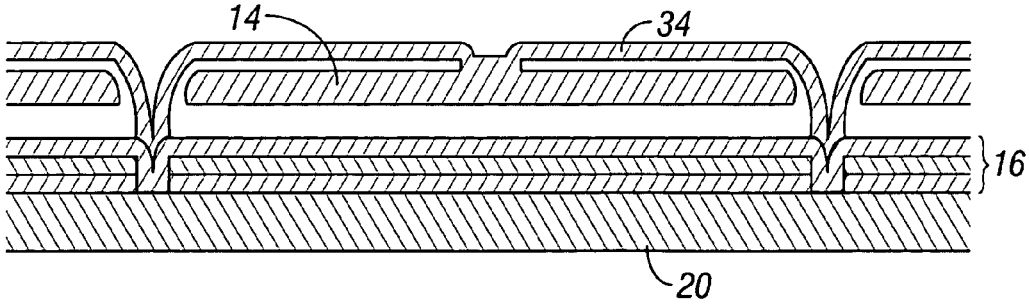
FIG. 7C is a cross section of another alternative embodiment of an interferometric modulator.
Figure 7D:
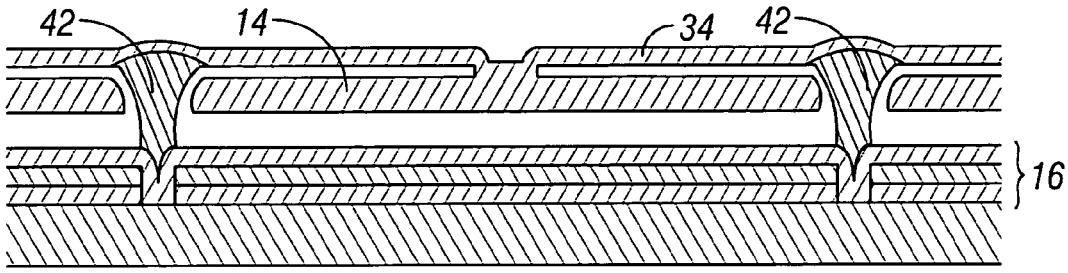
FIG. 7D is a cross section of yet another alternative embodiment of an interferometric modulator.
Figure 7E:
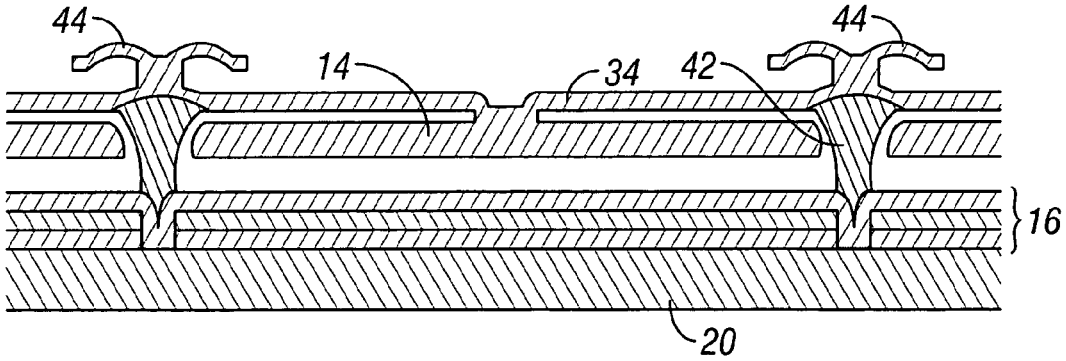
FIG. 7E is a cross section of an additional alternative embodiment of an interferometric modulator.

The details of the structure of interferometric modulators that operate in accordance with the principles set forth above may vary widely. For example, FIGS. 7A-7E illustrate five different embodiments of the movable reflective layer 14 and its supporting structures. FIG. 7A is a cross section of the embodiment of FIG. 1, where a strip of metal material 14 is deposited on orthogonally extending supports 18. In FIG. 7B, the moveable reflective layer 14 is attached to supports at the comers only, on tethers 32. In FIG. 7C, the moveable reflective layer 14 is suspended from a deformable layer 34, which may comprise a flexible metal. The deformable layer 34 connects, directly or indirectly, to the substrate 20 around the perimeter of the deformable layer 34. These connections are herein referred to as support posts. The embodiment illustrated in FIG. 7D has support post plugs 42 upon which the deformable layer 34 rests. The movable reflective layer 14 remains suspended over the cavity, as in FIGS. 7A-7C, but the deformable layer 34 does not form the support posts by filling holes between the deformable layer 34 and the optical stack 16. Rather, the support posts are formed of a planarization material, which is used to form support post plugs 42. The embodiment illustrated in FIG. 7E is based on the embodiment shown in FIG. 7D, but may also be adapted to work with any of the embodiments illustrated in FIGS. 7A-7C as well as additional embodiments not shown. In the embodiment shown in FIG. 7E, an extra layer of metal or other conductive material has been used to form a bus structure 44. This allows signal routing along the back of the interferometric modulators, eliminating a number of electrodes that may otherwise have had to be formed on the substrate 20.

In embodiments such as those shown in FIG. 7, the interferometric modulators function as direct-view devices, in which images are viewed from the front side of the transparent substrate 20, the side opposite to that upon which the modulator is arranged. In these embodiments, the reflective layer 14 optically shields some portions of the interferometric modulator on the side of the reflective layer opposite the substrate 20, including the deformable layer 34 and the bus structure 44. This allows the shielded areas to be configured and operated upon without negatively affecting the image quality. This separable modulator architecture allows the structural design and materials used for the electromechanical aspects and the optical aspects of the modulator to be selected and to function independently of each other. Moreover, the embodiments shown in FIGS. 7C-7E have additional benefits deriving from the decoupling of the optical properties of the reflective layer 14 from its mechanical properties, which are carried out by the deformable layer 34. This allows the structural design and materials used for the reflective layer 14 to be optimized with respect to the optical properties, and the structural design and materials used for the deformable layer 34 to be optimized with respect to desired mechanical properties.

It is one aspect of the above described devices that charge can build on the dielectric between the layers of the device, especially when the devices are actuated and held in the actuated state by an electric field that is always in the same direction. For example, if the moving layer is always at a higher potential relative to the fixed layer when the device is actuated by potentials having a magnitude larger than the outer threshold of stability, a slowly increasing charge buildup on the dielectric between the layers can begin to shift the hysteresis curve for the device. This is undesirable as it causes display performance to change over time, and in different ways for different pixels that are actuated in different ways over time. As can be seen in the example of FIG. 5B, a given pixel sees a 10 volt difference during actuation, and every time in this example, the row electrode is at a 10 V higher potential than the column electrode. During actuation, the electric field between the plates therefore always points in one direction, from the row electrode toward the column electrode.

This problem can be reduced by actuating the MEMS display elements with a potential difference of a first polarity during a first portion of the display write process, and actuating the MEMS display elements with a potential difference having a polarity opposite the first polarity during a second portion of the display write process. This basic principle is illustrated in FIGS. 8.

Figure 8:
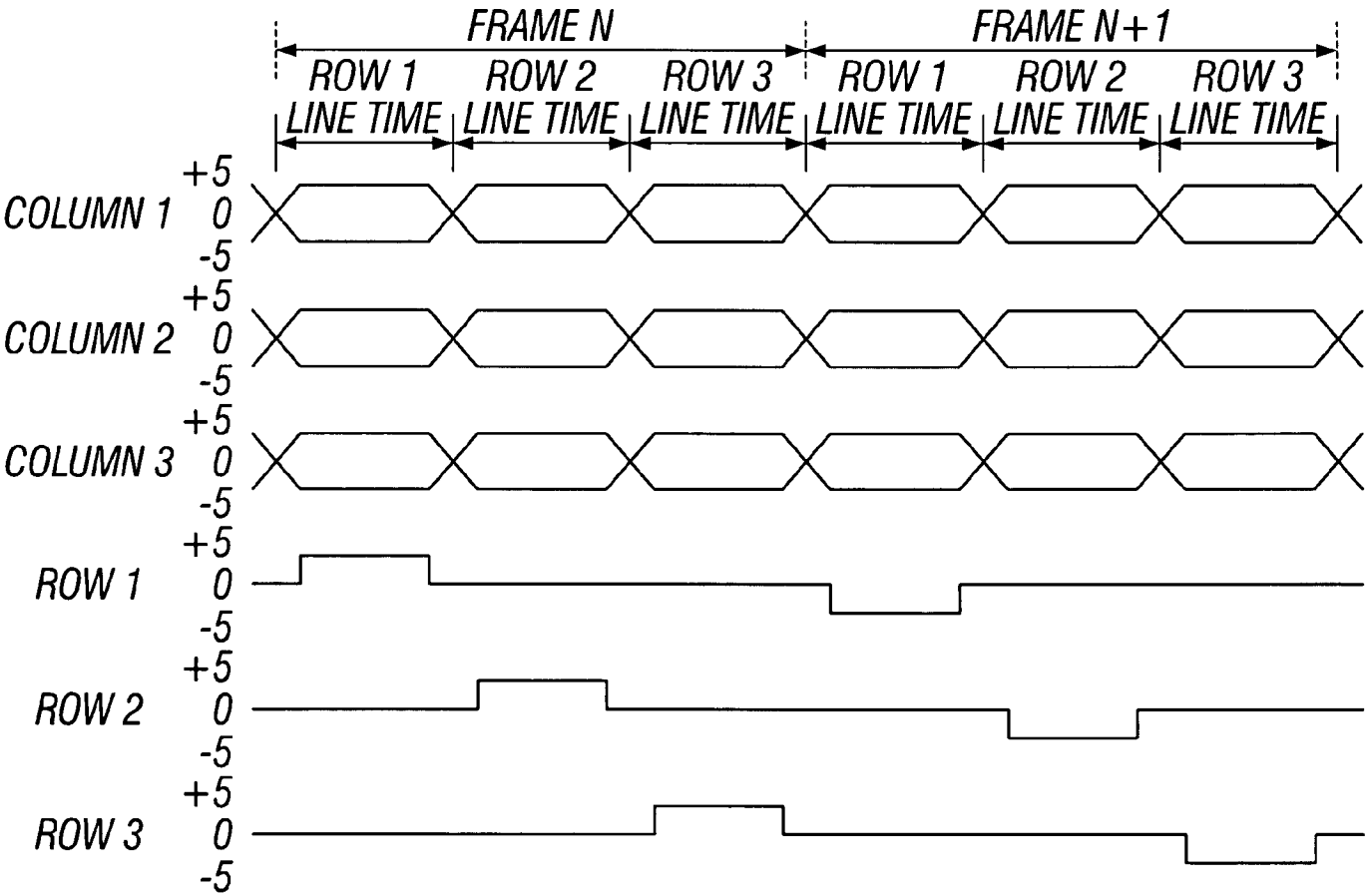
FIG. 8 is an exemplary timing diagram for row and column signals that may be used in one embodiment of the invention.

In FIG. 8, two frames of display data are written in sequence, frame N and frame N+1. In this Figure, the data for the columns goes valid for row 1 (i.e., either +5 or −5 depending on the desired state of the pixels in row 1) during the row 1 line time, valid for row 2 during the row 2 line time, and valid for row 3 during the row 3 line time. Frame N is written as shown in FIG. 5B, which will be termed positive polarity herein, with the row electrode 10 V above the column electrode during MEMS device actuation. During actuation, the column electrode may be at −5 V, and the scan voltage on the row is +5 V in this example. Such a frame is called a "write+" frame herein.

Frame N+1 is written with potentials of the opposite polarity from those of Frame N. For Frame N+1, the scan voltage is −5 V, and the column voltage is set to +5 V to actuate, and −5 V to release. Thus, in Frame N+1, the column voltage is 10 V above the row voltage, termed a negative polarity herein. Such a frame is called a "write−" frame herein. As the display is continually refreshed and/or updated, the polarity can be alternated between frames, with Frame N+2 being written in the same manner as Frame N, Frame N+3 written in the same manner as Frame N+1, and so on. In this way, actuation of pixels takes place in both polarities. In embodiments following this principle, potentials of opposite polarities are respectively applied to a given MEMS element at defined times and for defined time durations that depend on the rate at which image data is written to MEMS elements of the array, and the opposite potential differences are each applied an approximately equal amount of time over a given period of display use. This helps reduce charge buildup on the dielectric over time.

A wide variety of modifications of this scheme can be implemented. For example, Frame N and Frame N+1 can comprise different display data. Alternatively, it can be the same display data written twice to the array with opposite polarities. It can also be advantageous to dedicate some frames to setting the state of all or substantially all pixels to a released state, and/or setting the state of all or substantially all the pixels to an actuated state prior to writing desired display data. Setting all the pixels to a common state can be performed in a single row line time by, for example, setting all the columns to +5 V (or −5 V) and scanning all the rows simultaneously with a −5 V scan (or +5 V scan).

In one such embodiment, desired display data is written to the array in one polarity, all the pixels are released, and the same display data is written a second time with the opposite polarity. This is similar to the scheme illustrated in FIG. 8, with Frame N the same as Frame N+1, and with an array releasing line time inserted between the frames. In another embodiment, each display update of new display data is preceded by a releasing row line time.

In another embodiment, a row line time is used to actuate all the pixels of the array, a second line time is used to release all the pixels of the array, and then the display data (Frame N for example) is written to the display. In this embodiment, Frame N+1 can be preceded by an array actuation line time and an array release line time of opposite polarities to the ones preceding Frame N, and then Frame N+1 can be written. In some embodiments, an actuation line time of one polarity, a release line time of the same polarity, an actuation line time of opposite polarity, and a release line time of opposite polarity can precede every frame. These embodiments ensure that all or substantially all pixels are actuated at least once for every frame of display data, reducing differential aging effects as well as reducing charge buildup.

Although these polarity reversals have been found to improve long term display performance, it has been found beneficial to perform these reversals in a relatively unpredictable manner, rather than alternating after every frame, for example. Reversing write polarity in a random, pseudo-random, or any relatively complicated pattern (whether deterministic or non-deterministic) helps prevent non-random patterns in the image data from becoming "synchronized" with the pattern of polarity reversals. Such synchronization can result in a long term bias in which some pixels are actuated using voltages of one polarity more often than the opposite polarity.

Figure 9:
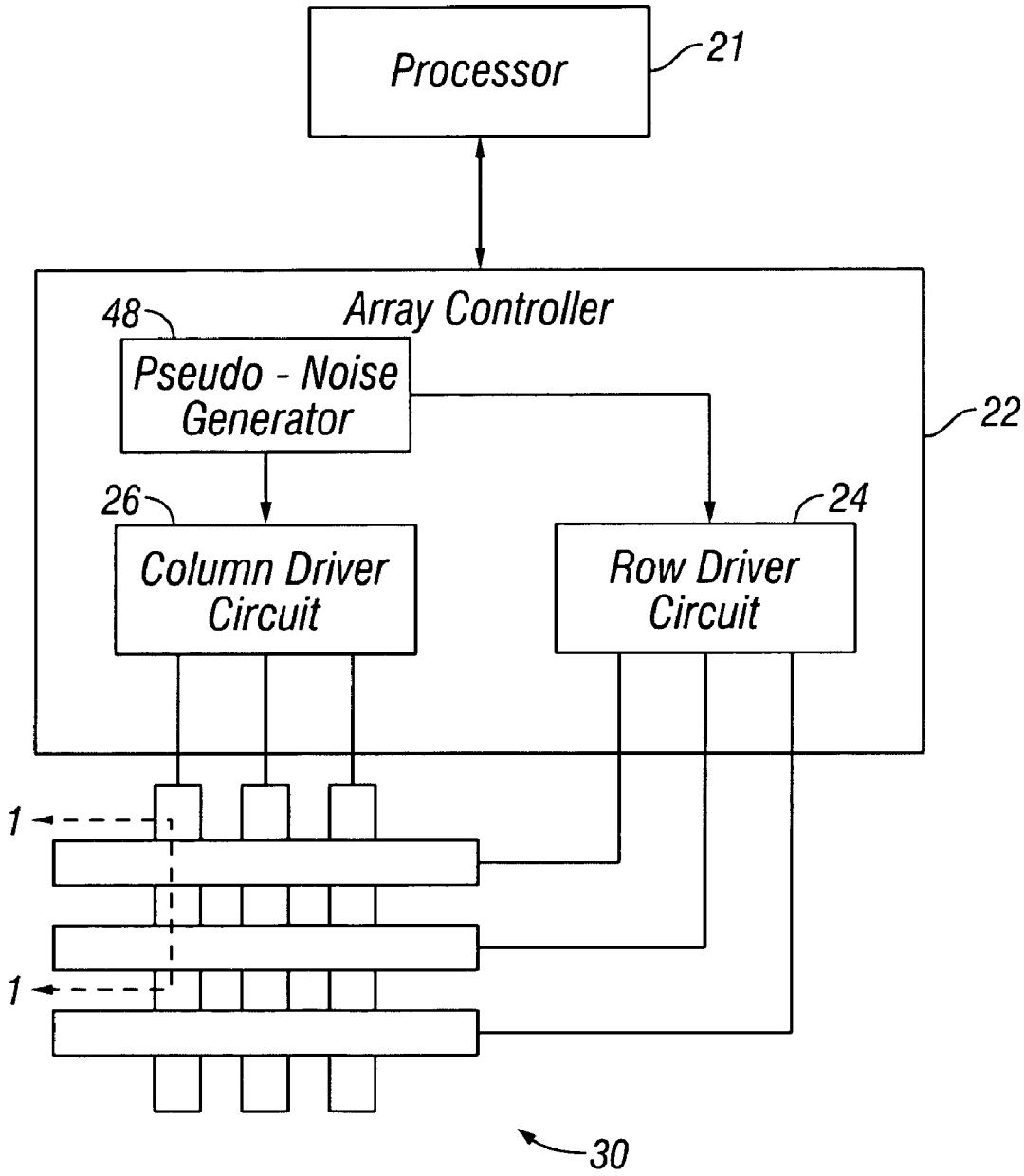
FIG. 9 is a block diagram of a display system in accordance with one embodiment of the invention.

In some embodiments, as illustrated in FIG. 9, a pseudo-noise generator 48, is used to produce a series of output bits, one per displayed frame. The output bit value may be used to determine whether the data is written with a positive polarity (a write+or w+ frame) or negative polarity (a write− or w− frame). For example, output 1 could signify that the next frame is written positive polarity, and output 0 could indicate that the next frame is written with negative polarity. Alternatively, the output bit could determine whether the next frame is written with the same or opposite polarity of the previous frame. Thus, even though the pseudo noise generator can be designed to output, over a given time scale, exactly the same number of zeros and ones, producing a dc balanced writing process, the distribution of the zeros and ones over that time can be a essentially devoid of non-random patterns that could interact in undesirable ways with non-random patterns in the image data.

It will be appreciated that in general, an output bit can be generated every n rows written, where n can be any integer from 1 upward. If n=1, potential "flips" of polarity can occur as each row is written. If n is the number of rows of the display, polarity flips can occur with each new frame. Thus, the pseudo-noise generator can be configured to output a bit for every n rows as desired.

Figure 10:
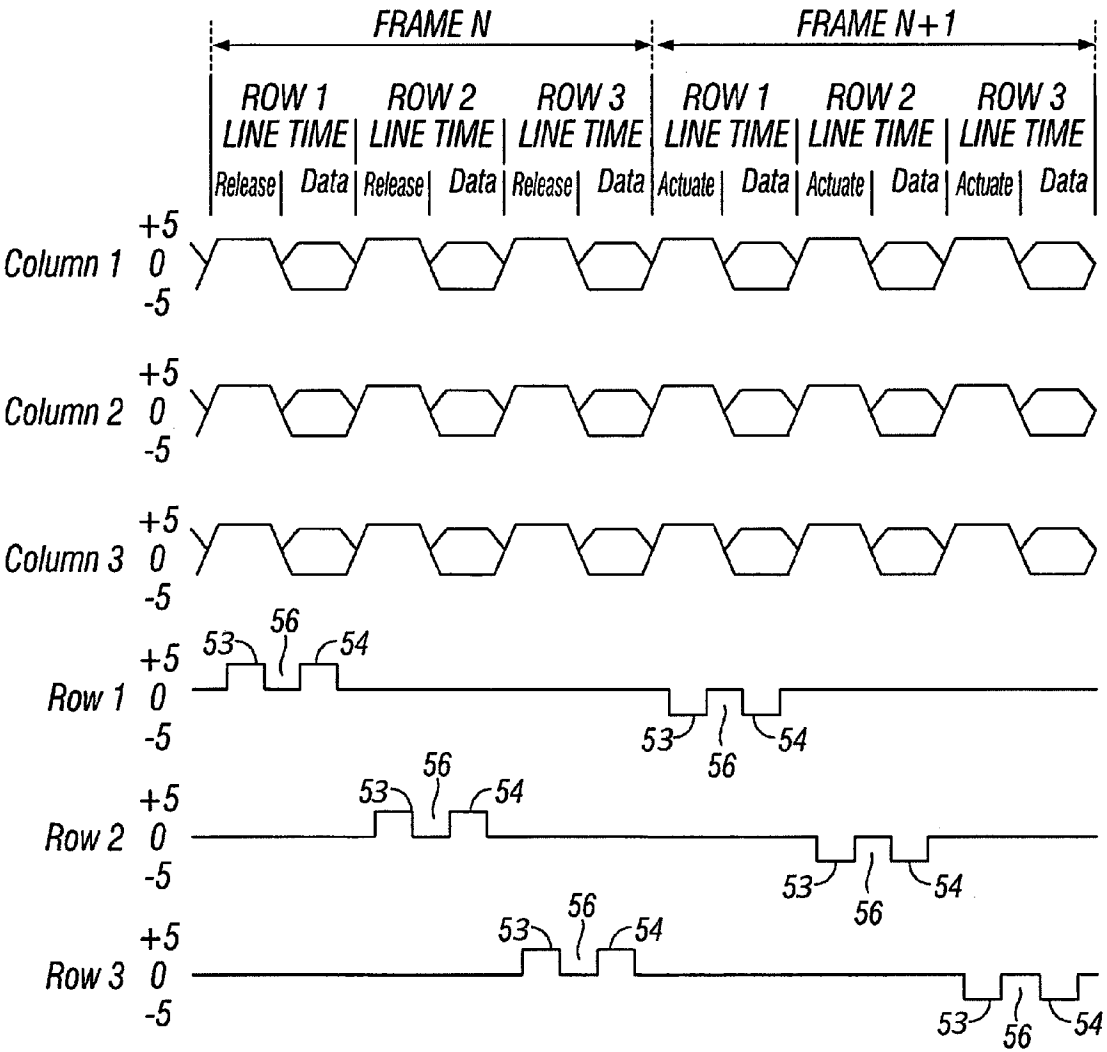
FIG. 10 is an exemplary timing diagram of a double row strobe to actuate or clear pixels of a row prior to writing data to the row.

In some embodiments, each row of a frame may be written more than once during the frame writing process. For example, when writing row 1 of Frame N, the pixels of row 1 could all be released, and then the display data for row 1 can be written with positive polarity. The pixels of row 1 could be released a second time, and the row 1 display data written again with negative polarity. Actuating all the pixels of row 1 as described above for the whole array could also be performed. This feature can be implemented by performing two strobes in every line time. One embodiment of this is illustrated in FIG. 10. During the first strobe 53 all the columns are held at the same potential so that the first strobe either actuates all the pixels in the row (referred to herein as a "one clear" operation), or the first strobe releases all the pixels in the row (referred to herein as a "zero clear" operation"). In the embodiment illustrated in FIG. 10, Frame N is a write+ frame, and all the columns are held to +5 V during the first portion of the row 1 line time during the first strobe 53. This releases all the pixels of row 1. During the second portion of the row 1 line time during the second strobe 54, the row 1 data is presented on the columns, thus writing row 1 with the row 1 data as described in detail above. This is repeated for all the rows of the display to write Frame N.

The next frame, Frame N+1, is a write- frame. This time, all of the columns are again brought to +5 V during the first portion of the line time for each row during the first strobe 53. Since this is a write- frame, this will actuate all the pixels of each row. During the second strobe 54 for each row, the data is presented as necessary for a write− frame. As stated above, the data for Frame N and Frame N+1 could be the same data or different data.

In these embodiments, whether the first strobe is used to actuate all the pixels of the row or release all the pixels of the row can change for different frames of image data. In one embodiment, the polarity of the second strobe that is used to write the data to the row is determined by whether the frame being written is a w+ frame or a w− frame (which could alternate from frame to frame for example), the polarity of the first strobe is the same as the polarity of the second strobe, and the data presented on the columns during the first strobe is determined based on the polarity of the first strobe and whether it is desired for that frame to pre-actuate all pixels of the row or pre-release all the pixels of the row before writing the data with the second strobe. The selection of releasing or actuating could, for example, alternate from row to row or from frame to frame.

For the same reasons described above, the selection of whether to perform a one clear or a zero clear and the determination of whether the frame is a write+ frame or a write− frame can also be advantageously performed in a random or pseudo-random manner. Thus, the determination of whether the frame is a write+ or write− frame could be made based on a first output of the first pseudo-noise generator 48, and the determination of whether to perform a one clear or a zero clear prior to writing data could be determined by a second output of the pseudo-noise generator 48. Generally, it is preferred for both strobes in one line time to have the same voltage value. In this case, it is possible to use a single long strobe for both portions of the line time (e.g. without the gap 56 illustrated in FIG. 10), and just modulate the column voltages to perform the one clear or zero clear followed by data writing to the row. It is possible, however, to have the two strobes at different voltages, such as +5 V for the first portion of the line time, and −5 V for the second portion.

The above described embodiments are focused on systems that produce equal numbers of writes in the two different polarities. However, it is possible that variation from an exactly equal number is optimum because in some cases, the dielectric charging rate is not exactly symmetrical with polarity. In these cases, a long term bias toward one polarity may be best able to minimize charge buildup in the device. To accommodate this, the pseudo-noise generator can be designed to output a defined excess of 1s or 0s so as to produce a defined excess of write operations in one polarity rather than another.

It will be appreciated that the one clear and zero clear operations described herein may be performed at a lower or higher frequency than once every row write or every frame write during the display updating/refreshing process. Thus, the double row strobe described herein need not be applied to every row write operation to be effective at reducing performance and reliability problems with MEMS displays.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention. As one example, it will be appreciated that the test voltage driver circuitry could be separate from the array driver circuitry used to create the display. As with current sensors, separate voltage sensors could be dedicated to separate row electrodes. The scope of the invention is indicated by the appended claims rather than by the foregoing description. All changes which come within the meaning and range of equivalency of the claims are to be embraced within their scope.

The invention claimed is:

1. A method of writing a plurality of rows of image data to a display array, said display array comprising pixels that exhibit two different states, a first state and a second state, said method comprising:

for a first number of said rows, placing substantially all pixels in at least one of the first number of said rows in said first state that comprises a non-black state prior to writing any image data to the at least one of the first number of said rows; and for a second number of said rows, placing substantially all pixels in at least one of the second number of said rows in said second state that comprises a black state prior to writing any image data to the at least one of the second number of said rows.

2. The method of claim 1, wherein writing each row of image data to said array is preceded by either placing substantially all pixels in a corresponding row of said array in said first state or placing substantially all pixels in said corresponding row of said array in a second state.

3. The method of claim 1, wherein said first number of said rows and second number of said rows together comprise all rows of said array.

4. The method of claim 1, wherein said first number of said rows comprises approximately half of said rows of said array and said second number of said rows comprises approximately the other half of said rows of said array.

5. The method of claim 4, comprising alternating between placing substantially all pixels in said first number of said rows in said first state and placing substantially all pixels in said second number of said rows in said second state.

6. The method of claim 1, comprising selecting between placing substantially all pixels in said first number of said rows in said first state and placing substantially all pixels in said second number of said rows in said second state in a random or pseudo-random manner.

7. The method of claim 1, wherein said first state comprises a released state and wherein said second state comprises an actuated state.

8. The method of claim 1, wherein each pixel of said array is subjected to a series of voltages having either a first or a second polarity.

9. The method of claim 8, wherein each pixel of said array is subjected to a substantially equal number of voltages of each of said first and second polarities over a given time frame.

10. The method of claim 8, wherein each pixel of said array is subjected to a pre-defined unequal number of voltages of each of said first and second polarities over a given time frame.

11. A display apparatus comprising:

a display array comprising display elements that exhibit two different states; and a driver circuit configured to write rows of image data to at least one row of said display array; wherein said driver circuit is further configured to select at least one of two pre-write operations to be performed each time prior to writing any row of image data to said row of the display array, wherein a first of said pre-write operations places substantially all display elements in said row of the display array into a first state comprising a non-black state, and wherein a second of said pre-write operations places substantially all display elements in said row of the display array into a second state comprising a black state.

12. The display apparatus of claim 11, wherein said driver circuit is configured to select said pre-write operations in a random or pseudo-random manner.

13. The display apparatus of claim 11, further comprising:

a processor that is in electrical communication with said display, said processor being configured to process image data; and a memory device in electrical communication with said processor.

14. The apparatus of claim 13, further comprising a controller configured to send at least a portion of said image data to said driver circuit.

15. The apparatus of claim 13, further comprising an image source module configured to send said image data to said processor.

16. The apparatus of claim 15, wherein said image source module comprises at least one of a receiver, a transceiver, and a transmitter.

17. The apparatus of claim 13, further comprising an input device configured to receive input data and to communicate said input data to said processor.

18. A display apparatus comprising:

means for displaying image data on an array of pixels;

means for writing rows of image data to at least one row of said displaying means; and means for selecting at least one of two pre-write operations to be performed each time prior to writing any row of image data to said row of said displaying means, wherein a first of said pre-write operations places substantially all display elements in said row of said displaying means into a first state that comprises a non-black state, and wherein a second of said pre-write operations places substantially all display elements in said row of said displaying means into a second state that comprises a black state.

19. The display apparatus of claim 18, wherein said means for displaying comprises an array of interferometric modulators.

20. The display apparatus of claim 18, wherein said means for writing and said means for selecting comprise driver circuitry.

* * * * *

UNITED STATES PATENT AND TRADEMARK OFFICE

CERTIFICATE OF CORRECTION

PATENT NO. : 7,948,457 B2
APPLICATION NO. : 11/404449
DATED : May 24, 2011
INVENTOR(S) : Manish Kothari et al.

It is certified that error appears in the above-identified patent and that said Letters Patent is hereby corrected as shown below:

TITLE PAGE, Add

--Related U.S. Application Data, (60) Provisional application No. 60/678,473, filed on May 5, 2005.--.

At Column 1, Line 17, change “and or” to --and/or--.

At Column 5, Line 54, after “respectively” insert --.--.

At Column 7, Line 14, change “ore” to --or--.

At Column 8, Line 59, change “comers” to --corners--.

At Column 9, Line 62, change “FIGS.” to --FIG.--.

At Column 11, Line 10, change “write+or” to --write+ or--.

At Column 11, Line 40, change “53 all” to --53, all--.

Signed and Sealed this
Twenty-fourth Day of April, 2012

David J. Kappos

David J. Kappos
*Director of the United States Patent and Trademark Office*